US008375634B2

(12) United States Patent
Brandley et al.

(10) Patent No.: US 8,375,634 B2
(45) Date of Patent: Feb. 19, 2013

(54) MODULAR SHUTTER SYSTEM FOR POULTRY HOUSE VENTILATION AND INSULATION

(76) Inventors: Ari Meyer Brandley, Newnan, GA (US); John Theodore Brandley, Newnan, GA (US)

( * ) Notice: Subject to any disclaimer, the term of this patent is extended or adjusted under 35 U.S.C. 154(b) by 66 days.

(21) Appl. No.: 13/212,338

(22) Filed: Aug. 18, 2011

(65) Prior Publication Data

US 2012/0042571 A1 Feb. 23, 2012

Related U.S. Application Data

(60) Provisional application No. 61/375,207, filed on Aug. 19, 2010.

(51) Int. Cl.
*E06B 3/32* (2006.01)

(52) U.S. Cl. ..... 49/73.1; 49/74.1; 49/77.1; 49/87.1; 49/90.1; 49/504; 49/505

(58) Field of Classification Search ..... 49/73.1, 49/74.1, 77.1, 87.1, 90.1, 504, 505
See application file for complete search history.

(56) References Cited

U.S. PATENT DOCUMENTS

| | | | | | |
|---|---|---|---|---|---|
| 48,003 | A | * | 5/1865 | Wetzel | 49/87.1 |
| 188,908 | A | * | 3/1877 | Hopkins | 49/90.1 |
| 1,340,252 | A | * | 5/1920 | Rasmussen | 49/74.1 |
| 2,926,400 | A | * | 3/1960 | Mandel | 49/87.1 |
| 3,060,528 | A | * | 10/1962 | Scott | 49/87.1 |
| 3,284,951 | A | * | 11/1966 | Shapiro | 49/74.1 |
| 4,113,175 | A | | 9/1978 | Sutton, Jr. | |
| 4,513,534 | A | | 4/1985 | Siegwart | |
| 4,554,762 | A | * | 11/1985 | Anderson | 49/74.1 |
| 4,555,869 | A | * | 12/1985 | Kenkel | 49/449 |
| 4,999,948 | A | * | 3/1991 | Hodgens | 49/74.1 |
| 5,187,896 | A | * | 2/1993 | Ross | 49/74.1 |
| 5,191,735 | A | * | 3/1993 | Ross | 49/74.1 |
| 5,267,414 | A | * | 12/1993 | Vaida | 49/74.1 |
| 5,492,082 | A | | 2/1996 | Krevinghaus et al. | |
| 5,548,925 | A | * | 8/1996 | Marocco | 49/74.1 |
| 5,566,738 | A | * | 10/1996 | Yadidya | 160/133 |
| 5,794,380 | A | * | 8/1998 | Guardia | 49/74.1 |
| 5,921,028 | A | * | 7/1999 | Marocco | 49/403 |
| 6,219,985 | B1 | * | 4/2001 | Hsu | 52/473 |
| 6,250,012 | B1 | * | 6/2001 | Ricci | 49/87.1 |
| 6,449,903 | B1 | * | 9/2002 | Borcherding | 49/74.1 |
| 6,865,846 | B2 | * | 3/2005 | Hsu | 49/74.1 |
| 7,328,533 | B1 | * | 2/2008 | Coleman | 49/74.1 |

(Continued)

FOREIGN PATENT DOCUMENTS

| | | |
|---|---|---|
| CN | 20051080372 | 5/2006 |
| WO | WO03029597 | 4/2003 |

*Primary Examiner* — Katherine W Mitchell
*Assistant Examiner* — Clarence W Mayott, III
(74) *Attorney, Agent, or Firm* — J. T. Hollin, Attorney at Law, P.C.

(57) ABSTRACT

Disclosed is a modular assembly device for providing adequate and efficient ventilation, temperature control, and insulation in poultry houses. The disclosed invention relates to an automated or manually-operated modular shutter system for tunnel ventilation in poultry houses, the system being self-sealed by the poultry house's internal negative static pressure. All the shutters in a modular shutter unit are designed to open and close in unison by means of specially-designed hinges and hinge spacers. In the preferred embodiment, there are four shutters per modular shutter unit, all of the same construction and dimensions. The shutters are designed with beveled horizontal edges and end cap seals, which together provide an efficient and practically airtight fit against each other when closed. The shutters are also of sufficient thickness to accommodate internal insulation if necessary to raise the insulation values needed for the poultry houses in cold winter months.

7 Claims, 10 Drawing Sheets

U.S. PATENT DOCUMENTS

| | | | | |
|---|---|---|---|---|
| 7,377,074 | B2 * | 5/2008 | Marocco | 49/87.1 |
| 7,966,974 | B2 | 6/2011 | Lorton et al. | |
| 2004/0226219 | A1 * | 11/2004 | Hsu | 49/74.1 |
| 2007/0044787 | A1 | 3/2007 | Brice | |
| 2007/0157519 | A1 * | 7/2007 | Nien et al. | 49/74.1 |
| 2008/0295406 | A1 * | 12/2008 | Kollman et al. | 49/74.1 |
| 2009/0056226 | A1 * | 3/2009 | Zhang et al. | 49/74.1 |
| 2009/0120000 | A1 * | 5/2009 | Marocco | 49/74.1 |
| 2010/0236491 | A1 | 9/2010 | Rogge et al. | |

* cited by examiner

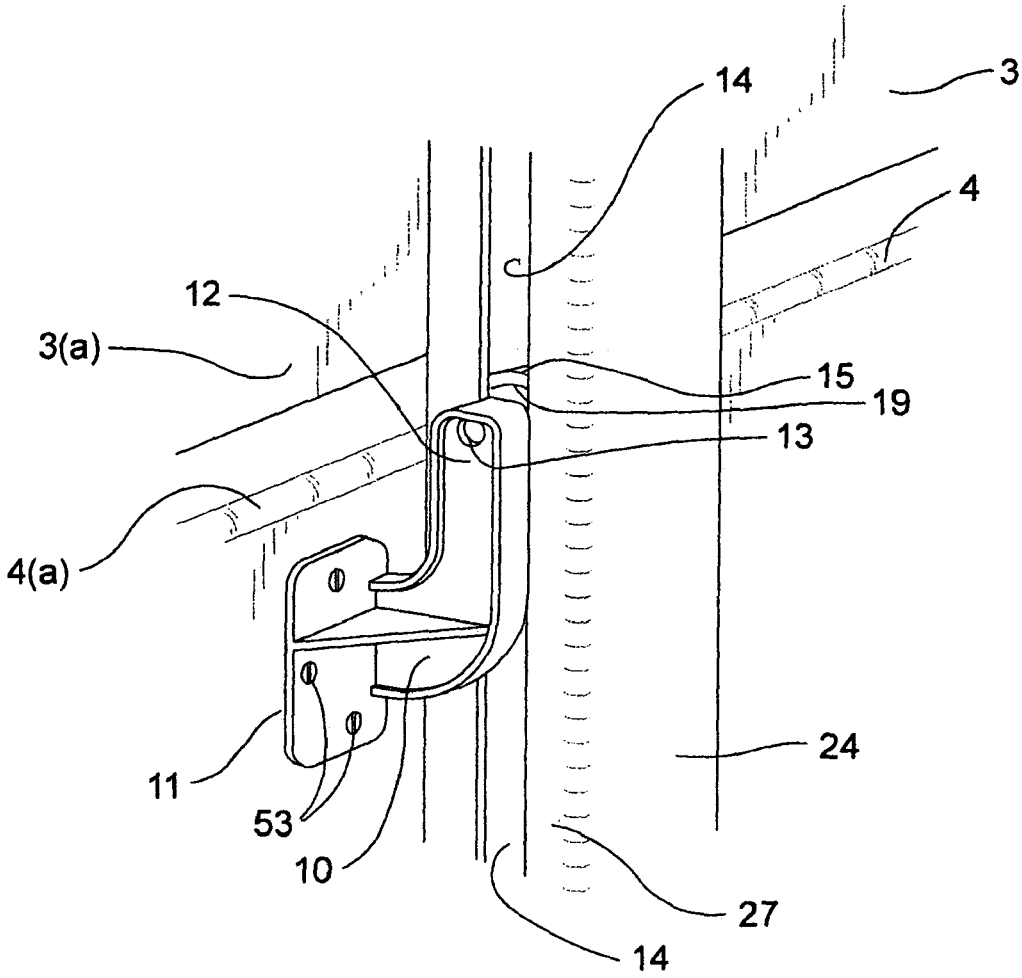
FIG. 3
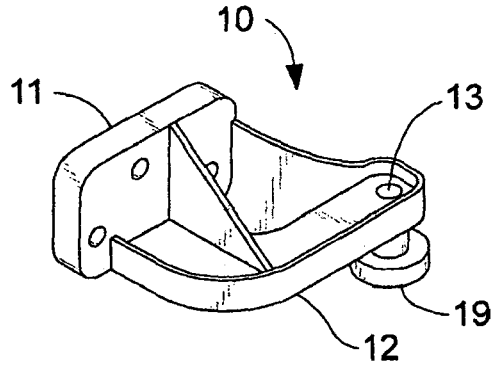
FIG. 3-A

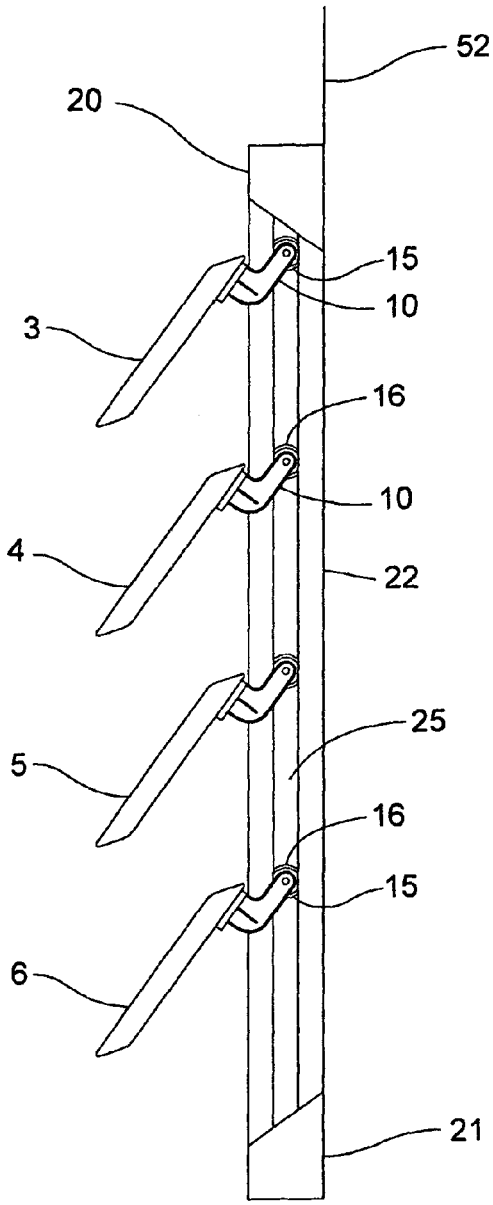
FIG. 13
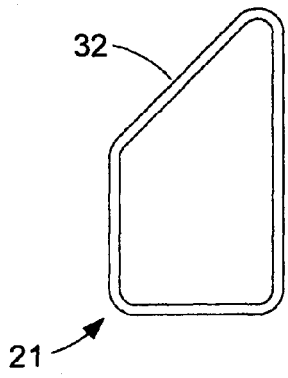
FIG. 13-A

MODULAR SHUTTER SYSTEM FOR POULTRY HOUSE VENTILATION AND INSULATION

REFERENCE TO RELATED APPLICATION

This application claims the benefit of priority of U.S. Provisional Application Ser. No. 61/375,207, filed on Aug. 19, 2010, and said provisional application is incorporated herein by reference.

STATEMENT REGARDING FEDERALLY SPONSORED RESEARCH OR DEVELOPMENT

Not applicable.

NAMES OF THE PARTIES TO A JOINT RESEARCH AGREEMENT

Not applicable.

BACKGROUND OF THE INVENTION (1) Field of the Invention

The inventive concepts presented herein generally are concerned with devices and methods for providing adequate and efficient ventilation, temperature control, and insulation in poultry houses. The disclosed invention relates to an automated and insulated modular shutter system for tunnel ventilation in poultry houses, the system being self-sealed by the poultry house's internal negative static pressure.

For the cooling of birds in poultry houses in summer, the generally accepted method is to draw a high volume of air into one end of the poultry house and exhaust the same air by fans at the opposite end. In these circumstances the poultry house becomes a wind tunnel with a velocity of airflow of approximately 600 feet per minute. The airflow cools the birds as it passes over them and the airflow further generates a lower static pressure relative to the air outside the poultry house. In order to control the airflow through the tunnel openings, the industry is currently using drop-curtains on the outside of the house located within an area attached to the house known as the "doghouse" area. An alternative solution is to utilize large tunnel doors located on the inside of the poultry house.

The problem with the curtains is that they have very little insulation value when they are closed in winter weather, and therefore the curtains considerably raise the cost of heating the poultry house. The disadvantage with the tunnel doors on the inside of the house is that they must be held shut against the constant internal negative static pressure of the house, which frequently causes them to warp and leak around the perimeter of the doors. This allows cold winter air to be drawn into the house and again, the total heating costs are increased considerably.

(2) Description of the Related Art

Various procedures, equipment, and techniques for raising poultry have been tried for the past 300 years. The following are a sampling of inventive efforts involving the operation of poultry houses.

U.S. Pat. No. 7,966,974 B2 (Jun. 28, 2011; Lorton et al.) discloses an apparatus for housing poultry including a wall with at least one light-absorbing ventilation fan for ventilating the facility and a movable curtain covering a curtain opening. A controller operates the movable curtain to expose an interior of the facility to natural light cycles of an outside environment for a first period and regulating light cycles of the interior for a second period, thereby mimicking daylight duration. The controller operates the movable curtain to limit exposure of an interior of the facility to light to produce a brown-out effect therein for enhancing physical development of the poultry.

US patent application publication 2010/0236491 A1 (Sep. 23, 2010; Rogge et al.) The invention herein is an animal husbandry tunnel door with adjoining extrusions for closing a tunnel ventilation opening typically in a broiler house has opposing faces with top, bottom and side edges. The faces sandwich an insulation layer. The adjoining extrusions have a first door top, bottom and side extrusion, along with a second door side edge extrusion. The first door top, bottom and side edge extrusions each have parallel inner prongs with barbs and adjacent parallel outer flanges forming two slots therebetween for receiving the top, bottom and side edges of the opposing door faces as the inner prongs with barbs pass into the insulation and are held thereat.

US patent application publication 2007/0044787 A1 (Mar. 1, 2007; Brice, M.) shows an air inlet damper apparatus for minimizing the entrance of outside air into a poultry house when the ventilation exhaust fans are running and the radiant tube heater is not operating. The apparatus has a housing with a passage and a coupling flange; a pin that spans the passage and divides the apparatus into a low pressure side and an outside high pressure side, where the low pressure side is in fluid communication with a blower supplying combustion air to the tube heater; a damper blade connected to the pin; a stop; and a means for controlling the damper blade. The controlling means is responsive to pressure. The damper blade pivotally opens away from the stop when there is a static pressure differential that is higher than the negative pressure created by the ventilation exhaust fans.

U.S. Pat. No. 5,492,082 (Feb. 20, 1996; Krevinghaus et al.) discloses a facility for housing animals such as poultry in a well-ventilated and temperature controlled environment. Featured is an electronic temperature controller system for providing manual control, as well as programmed operation, over a plurality of side wall curtains, a plurality of tunnel curtains, a plurality of side wall exhaust fans and a method to instantly visually check the status of, and program operation of each of these devices.

U.S. Pat. No. 4,113,175 (Sep. 12, 1978; Sutton, Jr., J.) is a ventilation method and system for automatically repositioning the adjustable closures in a poultry or livestock rearing facility. A pressure sensor measures the pressure differential between the inside and outside of the house resulting from the operation of one or more exhaust fans, and the adjustable closures are repositioned accordingly by a control device so that the fresh outside air drawn into the house through the ventilation openings enters at an optimum velocity for most effective ventilation of all areas of the house.

WO2002JP06611 (Apr. 10, 2003; Seikichi, F.) The device is a framed mechanism for swinging slats which serves to improve circulation, ventilation, and day-lighting by opening covering devices. Slats are arranged horizontally in a rain shutter door frame composed of upper and lower stiles, left and right rails, and a central stile. An operating slider for operating the swinging mechanism faces to the central stile. The sliding force of the operating slider is converted to a rotational force by a torsion bar and transmitted to the slats through a first transmitting member, a bar member, and a second transmitting member.

CN20051080372 (May 5, 2006; Chen, Z.) A shutter assembly is comprised of a first and a second fixing stile, and a plurality of louvers. Each of the first and second fixing stiles include a flange portion and a connection portion, and each of the louvers includes a rear portion, two lateral ends of which are rotatably connected to the connection portions of the first and the second fixing stile and a front portion for blocking light.

BRIEF SUMMARY OF THE INVENTIVE CONCEPT

The current inventive concept, entitled "Tunnel Shutter Modular System" is comprised of at least one modular shutter unit, or a plurality of modular shutter units connected together and all working as one system, opening and closing in unison at the same rate and at automatic intervals. However, when needed, the modular shutter units can also be designed to work independently for increased capabilities.

One modular shutter unit comprises three main components and five sub-components. The three main components of a modular shutter unit are the shutters, horizontal rails, and vertical rails. The five sub-components are lower couplers, upper couplers, hinges, hinge spacers, and tie bar brackets. Where automatic actuation of the shutters is required, appropriate operating or driving mechanisms may consist of various combinations of tie bars, torque tubes, and/or rack and pinion motion systems.

All the shutters in a modular shutter unit are designed to open and close together. In the preferred embodiment, there are four shutters per modular shutter unit and all four shutters are of the same construction and dimensions. For special design or functional requirements, certain of the shutters in a modular unit may have differing dimensions or configurations. The shutters are designed with beveled length-wise edges and seals, with the beveled edges of one shutter designed to fit snugly against any shutter to which it is adjacent. This feature provides an efficient and practically airtight fit shutter-to-shutter when a modular unit is closed. The shutters are also of sufficient thickness to accommodate internal insulation, which raises the insulation values needed for the poultry houses in cold winter months.

In preferred embodiments, each shutter is 48 inches in length by 14 inches in width, by 1.5 inches in thickness. For illustrative purposes the shutters disclosed in the drawing figures herein are of these general proportionate dimensions, strictly for ease of reference. However, the preferred dimensions may vary in accordance with the specific ventilation and/or insulation needs of poultry houses which are built in a particular geographic location or subject to different weather circumstances.

BRIEF DESCRIPTION OF THE VIEWS OF THE DRAWINGS

FIG. 3 illustrates a left shutter hinge, along with its hinge arm 12 and bracket 11, attached to a shutter and having its protruding wheel 19 confined within the slot of a vertical rail.

FIG. 3-A depicts an expanded view of a left shutter hinge, including its bracket, hinge arm, and protruding wheel.

FIG. 13 is a stylized presentation of the profile view of a modular unit with the shutters partially open.

FIG. 13A shows the profile of a horizontal rail, common to both a lower horizontal rail and an upper horizontal rail.

DETAILED DESCRIPTION OF THE INVENTIVE CONCEPT

The objects, features, and advantages of the inventive concept presented in this application are more readily understood when referring to the accompanying drawings. The drawings, from FIG. 1 through FIG. 13A, show the basic functions of various embodiments and methods of operation of the inventive concept. In the several figures, like reference numbers are used in each figure to correspond to the same component as may be depicted in other figures.

Figure 1:
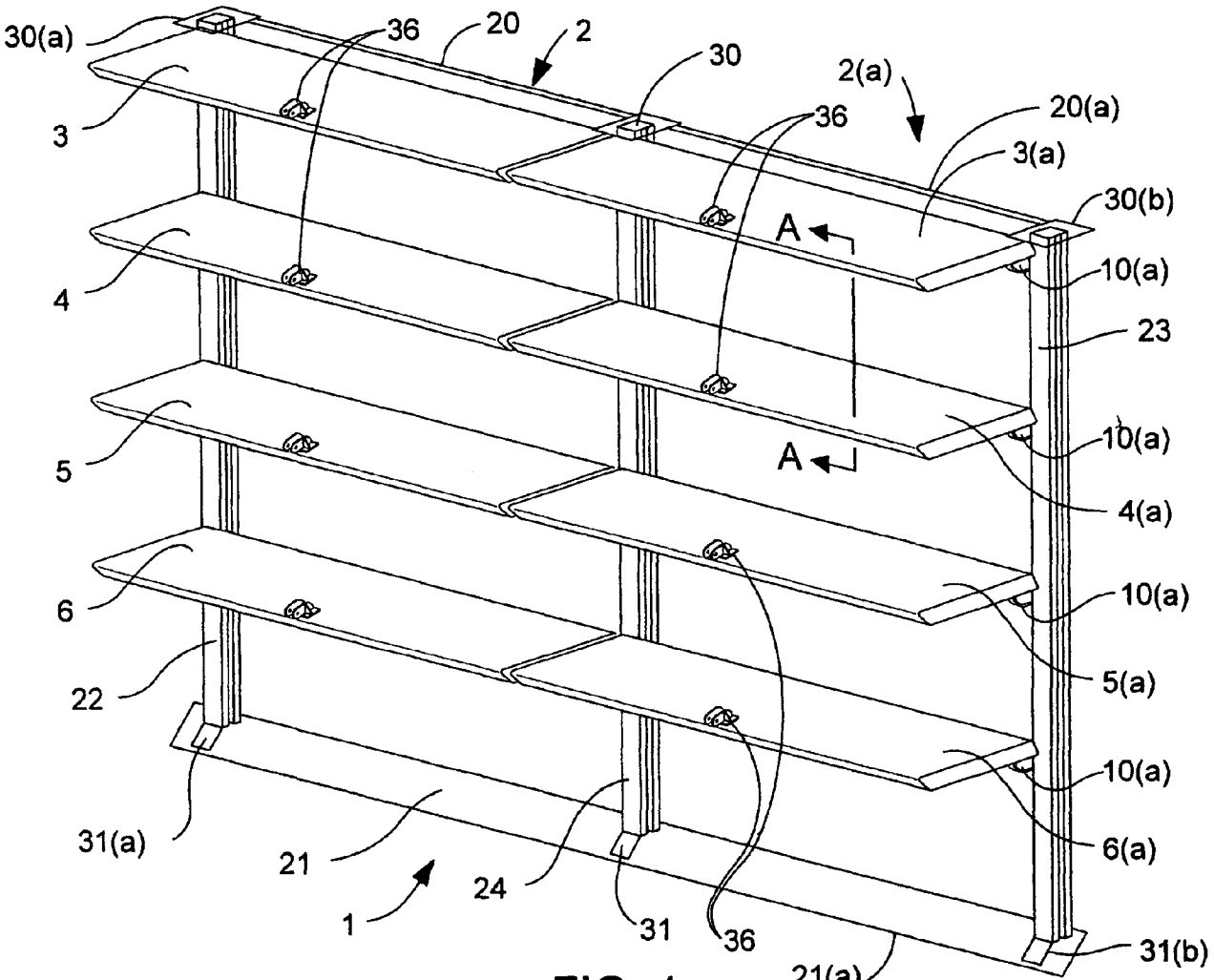
FIG. 1 shows a generalized view of two modular shutter units framed together to comprise a modular door assembly.

Beginning with an overview of the general working of the disclosed device. FIG. 1 gives a very general, comprehensive view of the preferred embodiment of this inventive concept. The general structural layout of a modular assembly 1 is shown in FIG. 1, which view comprises two modular shutter units 2, 2(*a*) having all shutters shown in the fully open position. The outer faces of the shutters are visible, while the inner face, or underside, of the shutters is not seen in FIG. 1. The two modular units 2, 2(*a*) are assembled side-by-side. The view displays four horizontal shutters 3, 4, 5, and 6, comprising the left modular shutter unit 2 and four shutters 3(*a*), 4(*a*), 5(*a*), and 6(*a*) comprising the right modular shutter unit 2(*a*). Two upper horizontal rails 20, a left vertical rail 22, a center vertical rail 24, a right vertical rail 22, and two lower horizontal rails 21, are collectively assembled into an orthogonal frame which structurally supports both modular shutter units 2, 2(*a*). The combined modular shutter units 2, 2(*a*) form a "modular door assembly" 1.

Figure 2:
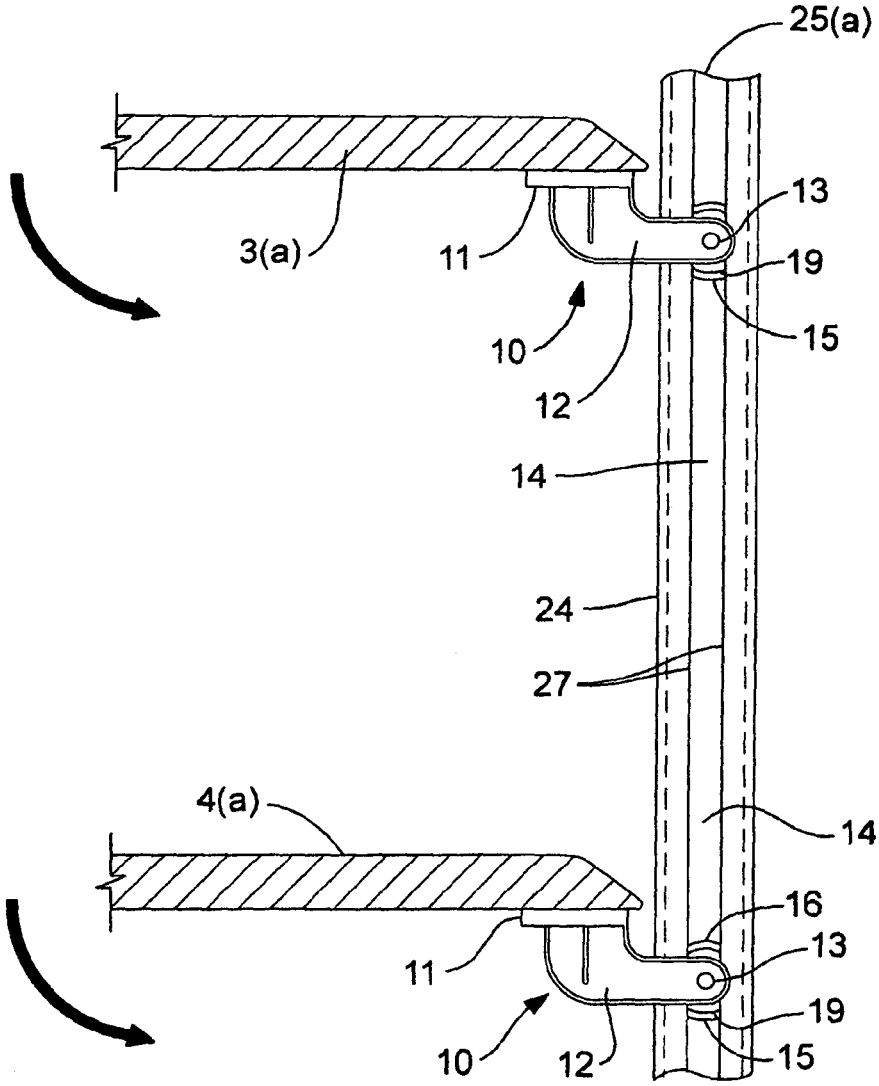
FIG. 2 is a cross-sectional view of the two topmost shutters of a modular shutter unit in the fully open position, the upper surface of each shutter being the outer face, and the lower surface being the inner face, or underside, of each shutter.

As will be explained shortly, all shutters 3, 4, 5, 6, 3(*a*), 4(*a*), 5(*a*), and 6(*a*) may be operated in any range of positions from fully closed to fully open. The shutter opening and closing movements are guided by paired hinges, a left hinge 10, and a right hinge 10(*a*) affixed to the respective left and right ends of each shutter. Due to the perspective view of FIG. 1, only a portion of the right hinges 10(*a*) of shutters 3(*a*) 4(*a*), 5(*a*), and 6(*a*) are visible. FIG. 2 presents a view of the left hinges 10, including their brackets 11 and protruding wheels 19 for the two shown shutters, 3(*a*) and 4(*a*). For ease and clarity of reference, when referring to all the shutters in a modular door assembly 1, the term "shutters 3-6(*a*)" will be used.

Figure 5:
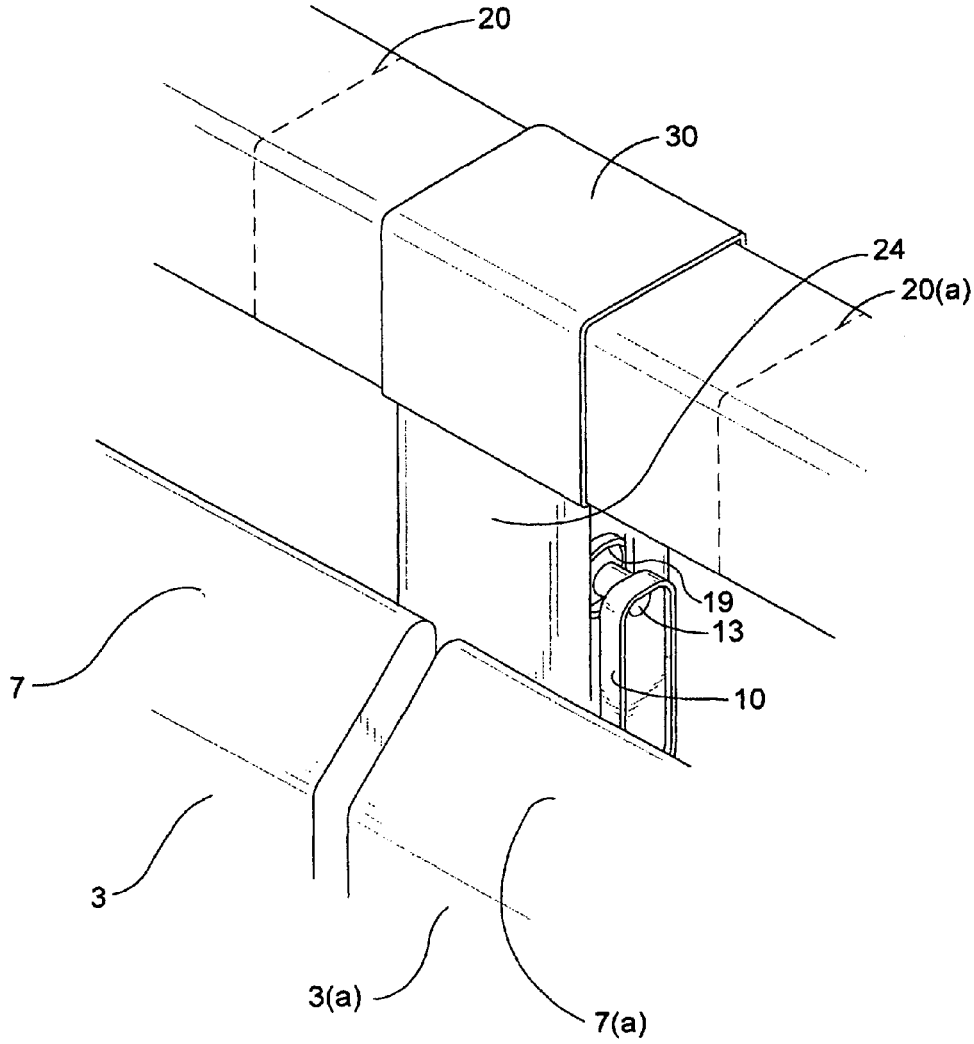
FIG. 5 shows an upper mid coupler placed in position over the center vertical rail and nestling two horizontal rails on either of its sides.
Figure 6:
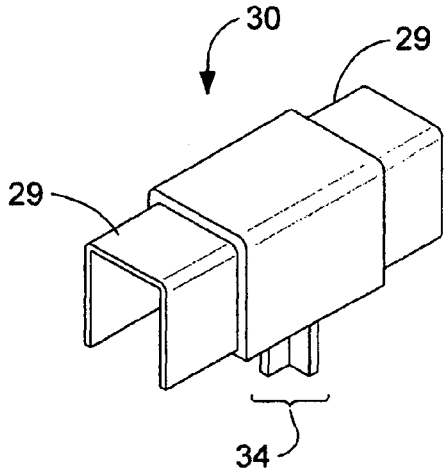
FIG. 6 is a close-up view of an upper coupler, including its wings extended on either side.
Figure 7:
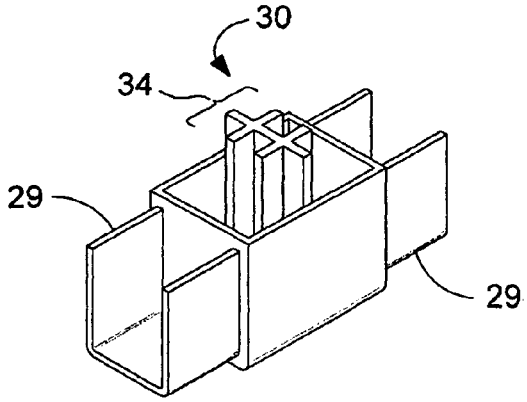
FIG. 7 is an inner view of a lower coupler, showing its matrix structure and its wings extended on either side.

Continuing at FIG. 1, the view therein shows that the two upper horizontal rails 20 are merged and connected immediately above the center vertical rail 24 by means of an upper mid coupler 30. A close-up view of the upper mid coupler 30 and its connection to the two upper horizontal rails 20 is seen in FIG. 5, while the upper mid coupler 30, including wings 29 which fit onto the horizontal rails 20 is displayed, detached from the frame in FIG. 6. The remaining two ends of the two upper horizontal rails 20, 20(*a*) are joined, respectively, to the left vertical rail 22 by use of an upper left coupler 30(*a*), while an upper right coupler 30(*b*) joins the right upper horizontal rail 20(*a*) to the right vertical rail 23. The two lower horizontal rails 21, 21(*a*) are merged and connected at the bottom of the center vertical rail 24 by means of a lower mid coupler 31. A detailed view of a lower mid coupler 31 can be seen by referring to FIG. 11 herein. The remaining two segments of the two lower horizontal rails 21, 21(*a*) are joined, respectively, to the left vertical rail 22 by use of a lower left coupler 31(*a*), while a lower right coupler 31(*b*) joins the right lower horizontal rail 21(*a*) to the bottom of the right vertical rail 23. Thus, a frame-like structure, housing the shutters 3-6(*a*), is completed. This frame structure is sturdy and efficient enough to be built into a wall of the typical poultry house.

In moving from FIG. 1 to FIG. 2, there is presented expanded cross-sectional views of the right top shutter, 3(*a*) and the right mid-upper shutter 4(*a*). Both shutters are shown in the full open position as previously depicted in FIG. 1 and further, as would be viewed from the perspective of section line AA of FIG. 1. Each of the shutters 3(*a*), 4(*a*) is connected to the bracket 11 of a right hinge 10, while a protruding wheel 19, connected to the hinge arm 12, is slidably positioned within the rail slot 25 of the center vertical rail 24 shown. As the shutters 3(*a*), 3(*b*) rotate between the open and closed positions, the hinge 10 rotates about its axis 13. In FIG. 2, the outline of a hinge spacer 14 is shown, said spacer 14 being specifically dimensioned to provide for proper spacing and a snug fit between the right top shutter 3(*a*) and the right mid-upper shutter 4(*a*) when these two shutters are in the vertical, fully closed position.

The previously-described frame structure also provides a support system for shutter hinges 10, 10(*a*), which are connected to, and guide the movement of all shutters 3-6 and 3(*a*)-6(*a*). FIG. 2 shows that a center vertical rail 24 is the frame member to which the left side of shutters 3(*a*) and 4(*a*) are connected, by means of two left hinges 10 affixed to each shutter. The respective left hinges only 10 are visible, in accordance with the shutter segments defined by section line AA. In actual use, the exterior, ambient weather environment is to the left of the vertical rail 24, while the interior of the poultry house is the space to the right of the vertical rail 24.

Figure 4:
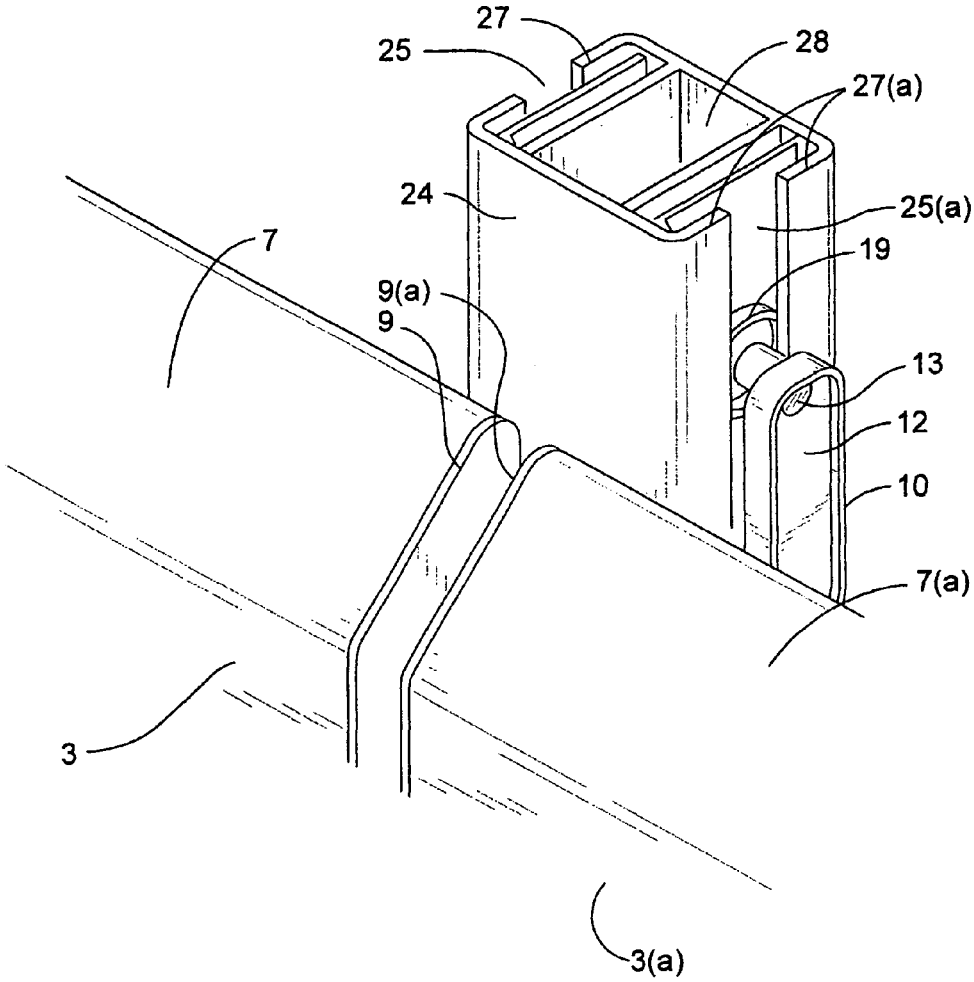
FIG. 4 presents a center vertical rail proximate a left top shutter and a right top shutter, further displaying a left hinge fitted into the slot of the center vertical rail.

A different perspective of the details of the frame structure is seen in FIG. 4, wherein is presented a view of the top end of an exposed center vertical rail 24, proximate both the left top shutter 3 and the right top shutter 3(*a*). In FIG. 4, the displayed shutters 3, 3(*a*), however, are in the fully closed position. It is seen that the center vertical rail 24 is comprised of essentially an oblong, rectangularly-shaped beam with an internal orthogonally-contoured rail shaft 28 which runs the entire length of the center vertical rail 24. Proximate the exterior surfaces of both long sides of the rail shaft 28 are length-long left and right rail slots 25 and 25(*a*). The rail slots 25, 25(*a*), are each defined by two rail-retaining ledges 27, 27(*a*). The ledges are formed from parallel ninety-degree bends of the outer walls of the center vertical rail 24.

It should also be noted, in FIG. 4, that the wheel 19 of the left shutter hinge 10 is deployed within the right rail slot 25(*a*) of the center vertical rail 24. The left shutter hinge 10 is affixed to the underside (not shown) of the right top shutter 3(*a*). Further, a right shutter hinge 10(*a*) (out of view) is attached to the underside of the immediately adjacent left top shutter 3. The corresponding wheel 19 of this right shutter hinge 10(*a*) (also out of view) has been inserted into the left rail slot 25 and its corresponding hinge bracket 11 is attached to the underside of the left top shutter 3. During the assembly process for the frame, hinges 10, 10(*a*) are attached to the respective left and right undersides of all the shutters 3-6(*a*).

After assembly of the modular unit 2 frame, the order of assembly of the shutters begins with the bottom-most shutter-hinge assembly. Referring to FIG. 1, and for illustrative purposes, a description will be depicted as starting on the right side of the modular shutter unit 2(*a*). The bottom-most shutter 6(*a*) is completed with the attachment of its respective left and right hinges 10, 10(*a*). Starting at the top end of each respective vertical rail 24, 23, the hinge wheels 19, attached to the hinges 10, 10(*a*) are inserted into the rail slots 25, 25(*a*), and the shutter is moved downward along the rail slots 25, 25(*a*), to its appropriate position. FIG. 4 presents a view of the open top end of the center vertical rail 24 and the manner of insertion of a hinge wheel 19.

The next step is inserting a hinge spacer 14 into the same rail slots 25, 25(*a*) until the lower notch 16 of each hinge spacer 14 rests upon the previously-inserted hinge wheels 19 (more accurately shown in FIG. 2). The next successive shutter-hinge assembly is inserted into the rail slots 25, 25(*a*), resulting in the hinge wheels 19 coming to rest upon the upper notches 15 of the spacer 14. There is an alternating insertion of shutters 1-6(*a*) and hinge spacers 14, as is depicted in the profile views shown in FIG. 2 and also in FIG. 13.

Figure 8:
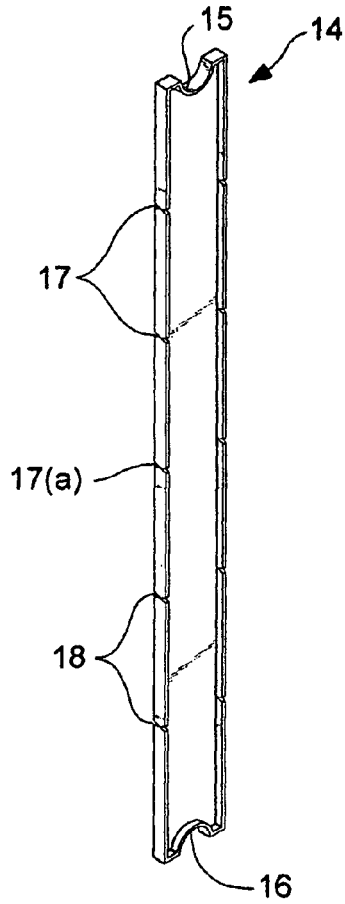
FIG. 8 illustrates a hinge spacer, also showing its upper notch 15 and its lower indent 16.

During assembly, any close-tolerance problematic fits of the hinge spacers 14 within the rail slots 25, 25(*a*) are managed by gentle bending or compression of pressure relief points at spacer cutouts 17, 17(*a*), 18, which are illustrated in FIG. 8.

Once all shutter-hinge assemblies are in place within the rail slots 25, 25(*a*) of all vertical rails 22, 23, 24 of a modular door assembly 1, FIG. 5 displays the arrangement in which the upper mid coupler 30 is placed atop the center vertical rail 24 and the upper horizontal rails 20, 20(*a*) are aligned and fitted within the inner structure of the upper mid coupler 30. A more detailed view of the upper mid coupler 30 is presented in FIG. 6 and FIG. 7. It is noted that the inverted view of the upper mid coupler 30 in FIG. 7 displays an "insert matrix" 34, the contours of which fit precisely into the rail shaft 28 of all vertical rails 22, 23, 24. Identical wings 29 are designed to securely fit onto the exterior surface of upper horizontal rails 20, 20(*a*) at the time of assembly of the frame of the device 1.

Key components of the inventive concept are the hinge spacers 14. If we refer again to FIG. 2, the bracket 11 of each hinge 10 is shown affixed to the underside of each of the shutters 3(*a*) and 4(*a*). The hinge arm 12 of each bracket 10 extends in an L-shaped pattern to encompass the hinge wheel 19, which defines the hinge axis 13. In FIG. 2, there is also shown a hinge spacer 14, which is designed to fit length-wise inside the rail slot 25 of the vertical rail 24. The hinge spacer 14 is of a length such that the upper notch 15 of the hinge spacer 14 contacts and provides rotational guidance to the wheel 19 of the hinge 10 attached to shutter 3(*a*). The spacer lower indent 16 guides and stabilizes the wheel 19 of the hinge 10 attached to shutter 4(*a*). Thus, hinge spacers 14 function as a support bushing for all hinges 10, 10(*a*). Another important function of each hinge spacer 14 is that of providing an exact amount of vertical separation of adjacent shutters so as to ensure an airtight fit between each abutting shutter when the shutters 3-6(*a*) are closed.

A different, close-up view of the left shutter hinge 10 connected to the right mid-upper shutter 4(*a*) is shown in FIG. 3, wherein the displayed shutters 3, 3(*a*), 4, and 4(*a*) are shown in the vertical, closed position. Screws 53 are used to attach the shutter bracket 11 to the underside of the shutter 4(*a*). FIG. 3A further presents a perspective of a left shutter hinge 10, wherein the structure of the hinge wheel 19 is displayed.

Figure 9:
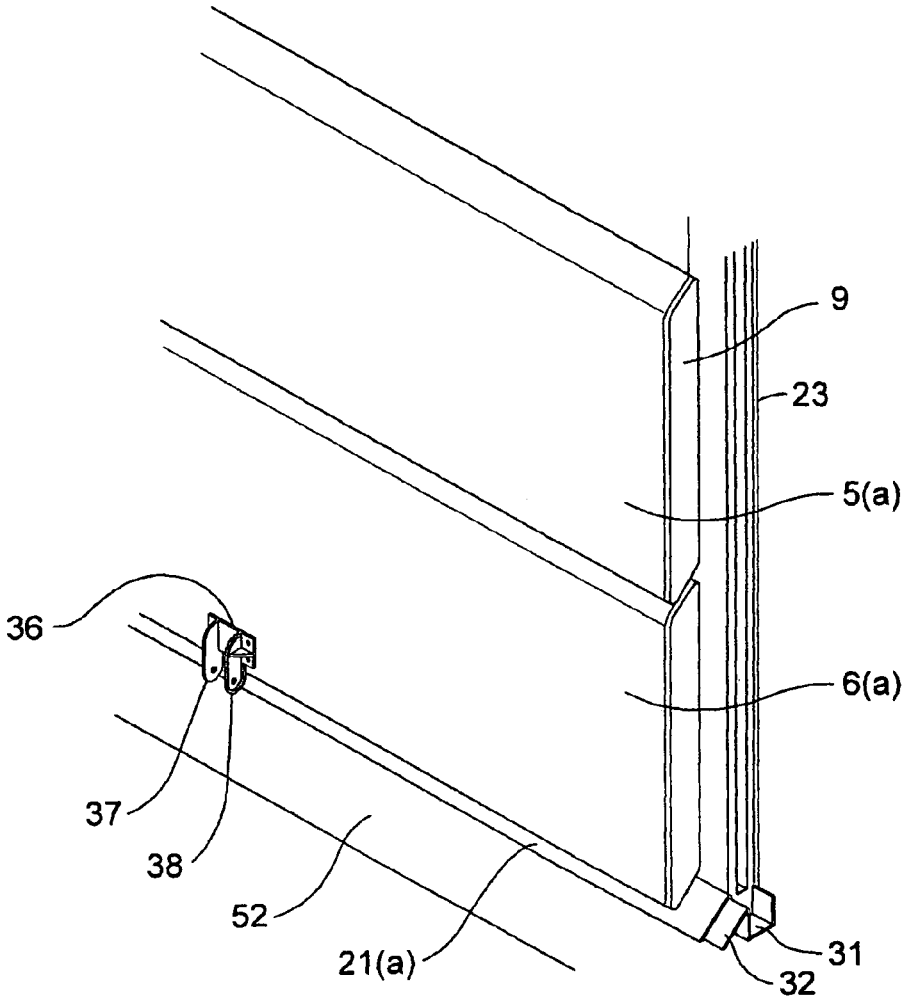
FIG. 9 depicts two of the bottom-most shutters of a modular shutter unit in the closed position with the lower shutter abutting the lower horizontal rail.
Figure 10:
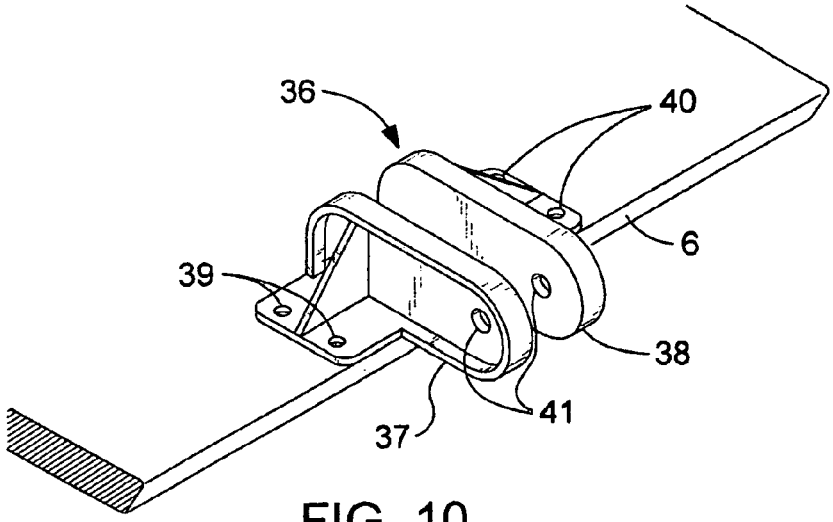
FIG. 10 illustrates a tie bar bracket, including two flanges and two pairs of holes 39, 40 for fastening into position on the lower mid-point of a shutter.
Figure 11:
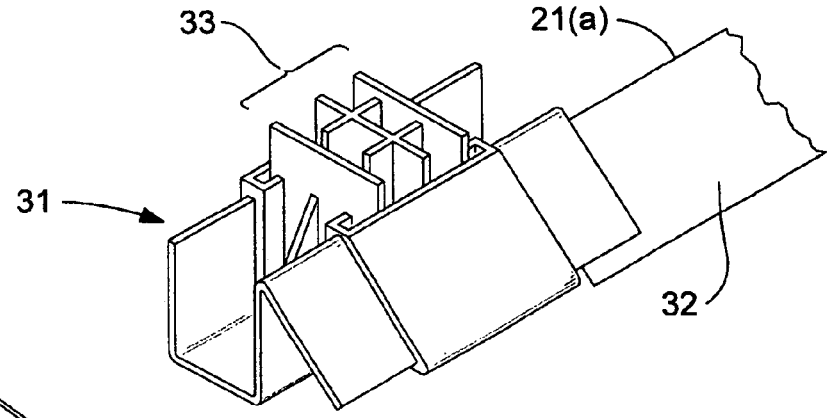
FIG. 11 displays a lower coupler, also showing the connecting insert matrix used for attaching to the bottom of vertical rails, with one horizontal rail shown for illustrative purposes.
Figure 12:
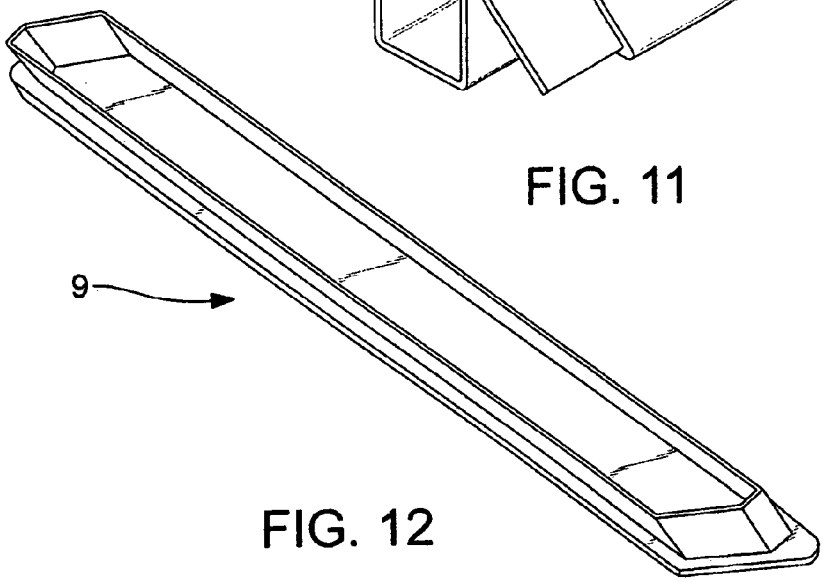
FIG. 12 shows a shutter end cap.

The lower couplers 31, 31(*a*), 31(*b*) are all of a common design, and are used to connect two adjacent lower horizontal rails 21, 21(*a*) and one vertical rail (either 22, 23, or 24) at a common junction. A close-up view of a lower mid coupler 31 is shown in FIG. 11, where it is seen that the lower mid coupler 31 is designed with a rail lower insert matrix 33, said matrix constructed so as to provide a snug fit when inserted into the bottom of a center vertical rail 24 during assembly of the frame of the modular shutter unit 2. Further, the lower mid coupler 31 is designed with resting surfaces 32 of an angle which corresponds to the profile of each lower horizontal rail 21, 21(*a*). Additionally the resting surfaces 32 match the orientation of the beveled edge of the shutters 6, 6(*a*) when the shutters 6, 6(*a*) are rotated fully closed. In this manner there is created a flush face seal with the bottom-most shutters 6, 6(*a*) of a modular unit 2. Turning to FIG. 9, there is shown a view of the shutter 6(*a*) in the closed position and flush with the lower horizontal rail 21(*a*).

In preferred embodiments, vertical rails are fabricated by plastic extrusion techniques, creating the slots 25, 25(*a*) that accommodate the shutter hinges 10, 10(*a*) and hinge spacers 14. This design eliminates the need for any attaching hardware, except for fastening mechanisms affixing the hinges 10, 10(*a*) to the undersides of all shutters 1-6*a*). All the main components and sub-components of this inventive concept can be fabricated from a wide variety of materials, including, but not limited to, foam board, plastic, metal, fiberglass, wood, and all types of composites materials.

Automated Operation

Figure 14:
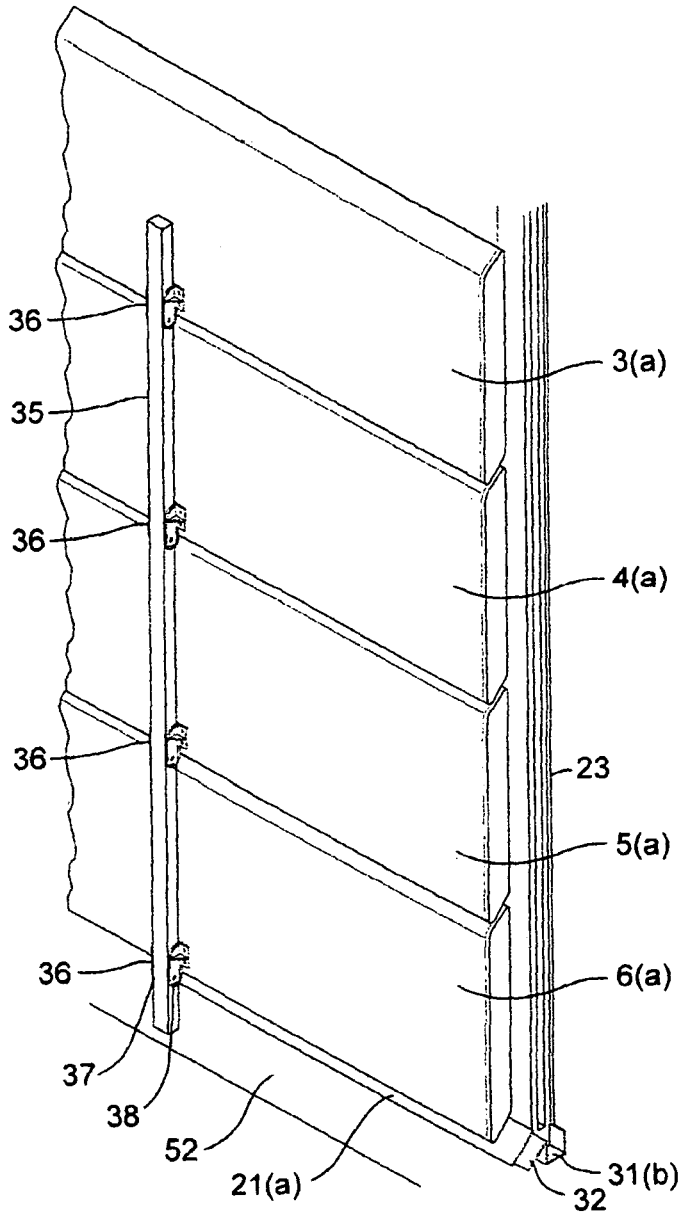
FIG. 14 displays a modular shutter unit with the shutters fully closed and a tie bar vertically attached to the tie bar brackets of each shutter.

When arranging for automatic operation of a modular door assembly 1, there must first be reference to FIG. 1, which displays two modular shutter units 2, 2(*a*) with all shutters fully open as both modular shutter units 2, 2(*a*), work in conjunction with each other. To achieve this type of synchronized operation, each of the tie bar brackets 36 on shutters 3, 4, 5, and 6 must be connected by a first vertically-oriented tie bar 35 individually fastened to each of the tie bar brackets 36. Likewise, a second tie bar 35 must be vertically affixed to each of the tie bar brackets 36 on shutters 3(*a*), 4(*a*), 5(*a*), 6(*a*). FIG. 14 presents an arrangement wherein a tie bar 35 is shown fastened to shutters 3(*a*), 4(*a*), 5(*a*), and 6(*a*) on modular shutter unit 2(*a*).

In a typical automated arrangement, both aforementioned tie bars 35 are connected to a torque tube and a rack and pinion gear drive mechanism.

A triggering device that may be predicated on poultry house interior temperature, relative air flow through the house, or interior static pressure will automatically send a pre-calibrated signal to the gear drive mechanism.

The signal received by the gear drive mechanism will automatically cause the torque tube to turn and simultaneously the two tie bars, through the tie bar bracket 36 connections, move all shutters 1-6(*a*) up or down, to the fully open or fully closed position, or any intermediate position. Several modular shutter units 2, 2(*a*) may be arranged in a multiple ventilating operation, and the units would be controlled independently from one another. A system of multiple units would allow all shutters to be used for "vent assist" and "tunnel transition" modes of operation. This arrangement substantially increases the efficiency of the temperature control systems of a poultry house.

In a manually-operated mode, the aforesaid torque tube may be attached to a cord which can be manually pulled and thereby manipulate the two tie bars 35 to position the shutters. 3-6(*a*).

In a non-powered operational mode, the modular door assembly 1 may be enclosed by shrouds. By adding shrouding to enclose (or box in) the modular shutter unit 2 the invention can be installed in the interior of a poultry house. The modular door assembly 1, or a single modular shutter unit 2, 2(*a*), could then be used in conjunction with the poultry house fans by installing the modular shutter unit 2, 2(*a*) on the interior of the house at the air intake of the fan. The modular shutter unit 2, 2(*a*) would not need the automated actuation system (torque tube, 45 power control gear system, etc) when used with the fans. The shutters 3-6 will open automatically when the associated fan powers on, by virtue of the pull of air flow through the shutters, which creates a negative air pressure relative to the outside air pressure. Once the associated fan is turned off, the shutters 3-6 would vertically drop closed into an airtight fit with the vertical rails, 22 23, and 24 and horizontal rails 21, 21(*a*). With the fan now off, there is an airtight seal caused by the residual negative air pressure still present within the poultry house. Additionally, there is the benefit of the added insulation value at the fan opening. Present fans used in poultry houses are constructed with metal or plastic intake shutters that have little to no insulation value. The inventive concept herein therefore provides an increased energy savings in the poultry industry.

While preferred embodiments of the present inventive concept have been shown and disclosed herein, it will be obvious to those persons skilled in the art that such embodiments are presented by way of example only, and not as a limitation to the scope of the inventive concept. Numerous variations, changes, and substitutions may occur or be suggested to those skilled in the art without departing from the intent, scope, and totality of the inventive concept. Such variations, changes, and substitutions may involve other features which are already known per se and which may be used instead of, or in addition to features already disclosed herein. Accordingly, it is intended that this inventive concept not be limited by the scope of the accompanying claims.

What is claimed is:

1. A modular, framed assemblage for the manual or automated, operation of shutters in controlling air flow, temperature, static pressure, and insulation within a poultry house, comprising an interlocking frame mechanism comprising an upper horizontal rail, a lower horizontal rail, two slotted vertical rails, two upper couplers, and two lower couplers;

a plurality of planar shutters of approximate dimensions comprising 48 inches in length by 14 inches in width, by 1.5 inches in thickness, having length-wise beveled edges and further, having an end cap affixed to the left and the right end of each of said shutters a plurality of L-shaped hinges having a hinge arm constructed with a protruding wheel at the longer end of said L-shape and having a bracket orthogonally affixed to the shorter end of said L-shape, wherein the diameter of said protruding wheel is of a dimension allowing insertion into the slot of said vertical rail;

a means for attaching the bracket of said hinges proximate each end of each of said shutters;

a tie bar bracket, constructed with two symmetrical flanges affixed to the midpoint of each said shutters, proximate the beveled edge; and a plurality of hinge spacers, each comprising (a) a lateral dimension providing for a longitudinal fit within the slot of said vertical rail, (b) an upper notch so as to provide rotational guidance to the circumference of the protruding wheel of a first said hinge, (c) a lower indent so as to provide rotational stabilization to the circumference of the protruding wheel of a second said hinge, and (d) a longitudinal dimension so as to provide an exact amount of vertical separation between the horizontal edges of adjacent shutters; and further, four of said hinge spacers are installed within the rail slot of each the left and the right vertical rail;

said shutters, with hinges attached, are assembled in a parallel, edge-abutting horizontal arrangement wherein the protruding wheels of said hinges, are placed into the slot of each of said vertical rails, in an alternating sequence with said hinge spacers, so as to provide for spacing between successive shutters and to further assist in the simultaneous, coordinated movement of all shutters to and from a vertical closed position to a horizontal open position, or any intervening position.

2. A modular, framed assemblage as in claim 1, further having a tie bar attached, in a vertical orientation, to each of said tie bar brackets affixed to said shutters.

3. A modular, framed assemblage as in claim 1, further comprising:

a tie bar attached, in a vertical orientation, to each of said tie bar brackets affixed to said shutters.

4. A modular, framed assemblage for the manual or automated operation of shutters enclosed within an orthogonally-shaped frame, in controlling air flow, temperature, static pressure, and insulation within a poultry house, wherein said assemblage comprises four shutters, each comprising a planar, rectangular-shaped structure having beveled edges along the entire length of said shutter, and further, having approximate dimensions comprising 48 inches in length by 14 inches in width, by 1.5 inches in thickness;

four tie brackets, wherein one of each said tie brackets is affixed to the lower midpoint of the outer face of each shutter, proximate its beveled edge;

a frame comprising (a) a left and a right, vertically-oriented, four-sided longitudinal member each having a lengthwise internal shaft and two length-wise rail slots extending the entire length of two opposing exterior sides of said rail; (b) one upper horizontal rail, primarily oblong and having a cross-section comprising a quadrilateral having two successive ninety-degree angles, one obtuse angle, and one acute angle, wherein said obtuse angle corresponds to the angle of the beveled edges of said shutters; (c) one lower horizontal rail, primarily oblong and having a cross-section comprising a quadrilateral having two successive ninety-degree angles, one obtuse angle, and one acute angle, wherein said obtuse angle corresponds to the angle of the beveled edges of said shutters; (d) two block-shaped upper couplers, each having a matrix section and identical mutually parallel wings constructed on both sides of said upper coupler; and (e) two block-shaped lower couplers each having a matrix center, mutually parallel wings constructed on both sides of said lower coupler, and two slanted resting surfaces extending from said parallel wings;

four L-shaped left hinges having a protruding wheel at the longer end of said L-shape and having a bracket at the shorter end of said L-shape, wherein;

four L-shaped right hinges having a protruding wheel and a bracket oriented in a manner diametrically opposed to that of said left hinges, wherein said left and right hinges comprise dimensions enabling a fit, of said protruding wheel member of said left and right hinges, within the slot of said respective left and right vertically-oriented, four-sided longitudinal members, a means for attaching the bracket of said hinges proximate the ends of each of said shutters;

eight hinge spacers, comprising (a) lateral dimension providing for a longitudinal fit within the slot of each of said left and right vertically-oriented, four-sided longitudinal members, (b) an upper notch so as to provide rotational guidance to the circumference of the protruding wheel of a first said hinge, (c) a lower indent so as to provide rotational stabilization to the circumference of the protruding wheel of a second said hinge, and (d) a longitudinal dimension so as to provide an exact amount of vertical separation between the horizontal edges of adjacent shutters; and further, four of said hinge spacers are installed within the rail slot of each the left and the right vertically-oriented longitudinal member wherein said shutters, with hinges attached, are assembled in a parallel, edge-abutting horizontal arrangement wherein the protruding wheels of said respective left and right hinges, are placed into the slot of each of said left and a right, vertically-oriented, four-sided longitudinal members, in an alternating sequence with said four respective hinge spacers, so as to provide for spacing between successive shutters and to further assist in the simultaneous, coordinated movement of all shutters to and from a vertical closed position to a horizontal open position, or any intervening position.

5. A modular, framed assemblage as in claim 4, wherein a tie bar is attached, in a vertical orientation, to each of said tie bar brackets affixed to said shutters.

6. A modular, framed assemblage for the manual or automated operation of two columns of shutters enclosed within an orthogonally-shaped frame, and utilized in controlling air flow, temperature, static pressure, and insulation within a poultry house, wherein said assemblage comprises eight shutters wherein each of said shutters comprises a planar, rectangular-shaped structure having beveled edges along the entire length of said shutter, and further, having dimensions comprising 48 inches in length by 14 inches in width, by 1.5 inches in thickness for each said shutter;

a frame comprising (a) three vertically-oriented, four-sided, longitudinal members each having a lengthwise interior shaft and two length-wise slots extending the entire length of opposing exterior sides of each of said rails, (b) two upper horizontal rails, primarily oblong, and each having a cross-section comprising a quadrilateral having two successive ninety-degree angles, one obtuse angle, and one acute angle, wherein said obtuse angle corresponds to the angle of the beveled edges of said shutters, (c) two lower horizontal rails, primarily oblong and having a cross-section comprising a quadrilateral having two successive ninety-degree angles, one obtuse angle, and one acute angle, wherein said obtuse angle corresponds to the angle of the beveled edges of said shutters, (d) three block-shaped upper couplers, each having a matrix section and identical mutually parallel wings constructed on both sides of said upper coupler and (e) three block-shaped lower couplers each having a matrix center, mutually parallel wings constructed on both sides of said lower coupler, and two slanted resting surfaces extending from said parallel wings;

a plurality of tie brackets wherein at least one of said tie brackets is affixed to the lower midpoint of the outer face of each shutter;

a plurality of L-shaped left hinges having a protruding wheel at the longer end of said L-shape and having a bracket at the shorter end of said L-shape;

a plurality of L-shaped right hinges having a protruding wheel and a bracket oriented in a manner diametrically opposed to that of said left hinges;

a plurality of hinge spacers; and a means for attaching the bracket of respective left hinges and right hinges proximate the respective ends of each of said shutters;

said modular assembly is constructed such that a frame comprising one left vertical rail, one center vertical rail, and one right vertical rail are connected to two upper horizontal rails and two lower horizontal rails, and further, (a) four of said shutters, each having one left hinge and one right hinge, respectively attached, are inserted, between said left vertical rail and said center vertical rail utilizing said protruding wheels, at alternating intervals with hinge spacers and the wheels of said brackets occupying alternate spaces within the slots of each of said vertical rails, (b) another group of four of said shutters, each having one left hinge and one right hinge, respectively attached, are inserted, between said right vertical rail and said center vertical rail utilizing said protruding wheels, at alternating intervals with hinge spacers such that (c) all four shutters, in each of two side-by-side columns of four shutters are capable of operating within the confines of said frame.

7. A modular, framed assemblage as in claim 6, wherein a tie bar is attached, in a vertical orientation, to each of said tie bar brackets affixed to those shutters comprising each respective column.

* * * * *